US008677946B2

(12) United States Patent
Deivasigamani et al.

(10) Patent No.: US 8,677,946 B2
(45) Date of Patent: Mar. 25, 2014

(54) HOT WATER SYSTEM CONFIGURATION, DESCALING AND HEATING METHODS THEREFORE

(75) Inventors: Sridhar Deivasigamani, Peoria, IL (US); Sivaprasad Akasam, Peoria, IL (US)

(73) Assignee: Intellihot Green Technologies, Inc., Galesburg, IL (US)

( * ) Notice: Subject to any disclaimer, the term of this patent is extended or adjusted under 35 U.S.C. 154(b) by 416 days.

(21) Appl. No.: 13/245,525

(22) Filed: Sep. 26, 2011

(65) Prior Publication Data

US 2012/0073519 A1 Mar. 29, 2012

Related U.S. Application Data

(60) Provisional application No. 61/386,560, filed on Sep. 26, 2010.

(51) Int. Cl.
*F24D 3/08* (2006.01)

(52) U.S. Cl.
USPC ..... 122/414; 236/20 R; 237/8 R

(58) Field of Classification Search
USPC ..... 122/40, 414, 415; 236/20 R, 12.13, 51, 236/93 R; 237/8 A, 8 D, 8 R, 2 A
See application file for complete search history.

(56) References Cited

U.S. PATENT DOCUMENTS

| | | | | |
|---|---|---|---|---|
| 5,205,318 | A * | 4/1993 | Massaro et al. | 137/337 |
| 5,555,850 | A * | 9/1996 | Garcia | 122/248 |
| 8,191,513 | B2 * | 6/2012 | Krause et al. | 122/415 |
| 8,544,761 | B2 * | 10/2013 | Deivasigamani et al. | 236/20 R |
| 2006/0230772 | A1 * | 10/2006 | Wacknov et al. | 62/199 |

OTHER PUBLICATIONS

"A" Series External Circulation Mode, Navien Gas Water Heater Owner's Operation Manual (for Models NR-180(A), NR-210(A), NR-240(A), NP-180(A), NP-210(A) and NP-240(A)), p. 28, Navien America Inc., 1371 Santa Fe Drive, Tustin CA 92780.

* cited by examiner

*Primary Examiner* — Gregory A Wilson
(74) *Attorney, Agent, or Firm* — Tracy Jong Law Firm; Tracy P. Jong; Cheng Ning Jong

(57) ABSTRACT

The present invention relates to a user activated hot water heater and control system for processing hot water to hot water output locations, e.g. faucet, shower, or the like, such that temperature fluctuations and delays in hot water delivery are reduced. The present invention provides energy savings resulting from smart activation of internal and/or external recirculation systems. Additionally, trickle flow is detected and responded to based on temperature responses at various points in the main flow line of the present configuration. Simultaneous internal and external recirculations are made possible with advantageous placement of a pump within internal and external recirculation loops and a solenoid valve within the internal recirculation loop. The present system further comprises a means for adjusting the pump action in response to a thermostatic valve, temperature sensors advantageously placed in the main flow line to reduce dead heading.

17 Claims, 8 Drawing Sheets

HOT WATER SYSTEM CONFIGURATION, DESCALING AND HEATING METHODS THEREFORE

RELATED APPLICATIONS AND PRIORITY CLAIM

This application claims priority to provisional application U.S. Ser. No. 61/386,560 filed Sep. 26, 2010. Said application is incorporated by reference herein in its entirety.

BACKGROUND OF THE INVENTION

1. The Field of the Invention

This application generally relates to fluid handling; and more particularly to controlling the temperature of water emanating from a hot water heating system at a user location.

2. Background Art

The method and apparatus associated with supplying and use of hot and cold running water is well known. Generally, for both residential and commercial applications, a municipal water supply line provides the water source wherein both hot and cold water services are derived.

The cold water service provided to a user is typically received directly from the municipal water supply line, bypassing any thermal treatment. This cold water service is considered "cold" regardless of the temperature of the water actually received at the output device (e.g. faucet, shower, washing machine, or the like) when cold water is requested. Hot water, on the other hand, is thermally processed via a hot water heating system (common hot water heating systems utilize: gas or electrically powered hot water tanks, as well as tank-less or on-demand type systems). Delays in obtaining cold water when demanded is rarely considered problematic when compared to preferred instantaneous heated water demands. Cold or unheated water is normally considered cold at its delivered equilibrium temperature, and is abundantly available throughout the water delivery system. Unfortunately, instantaneous heated water demand/delivery problems are well known and common place.

Instantaneous heated water demand/delivery problems typically exist when a user (or users) is directly interacting with the hot water in a real-time scenario, such as, for example, showering, washing hands, shaving, or the like. Requests for hot water where instantaneous hot water is a non-issue include: operating a washing machine, filling a bucket, or the like; in such scenarios, the user is not directly interacting with the hot water flow in a real-time physical manner. In such exemplary demands for hot water, the sensitivity to the cooler water initially drawn when hot water is requested is nonexistent or greatly reduced. The tolerance to such a large water temperature variation is primarily due to the absence of a human user interacting with the requested hot water output; unlike the situation with a washing machine, where the goal is merely to achieve a full tub at the desired final water temperature.

Other related issues associated with hot water demands include hot water supply line temperature fluctuations, time lag where a user is consuming (running) water waiting for the water to reach the desired temperature, variations in user preferences related to maximum hot water temperature setting, and burn-safety concerns. Safety concerns are typically associated with toddlers, the elderly and the disabled (reduced mental and/or physical capabilities).

Unfortunately, the pre-existing hot water heating systems do not provide adequate remedies or solutions to the aforementioned hot water demand problems and concerns. Such hot water demand problems, concerns, and limitations are overcome by the teachings of the present disclosure.

SUMMARY OF THE INVENTION

The present invention relates to a user activated hot water heater and control system for managing hot water parameters and processing conditions to hot water output locations ("HWOL") (e.g., faucet, shower, or the like) such that the delay in receiving hot water at the target temperature is minimized. Additionally, in tank-less hot water configurations, the temperature of the hot water delivered is optionally adjusted to a predetermined temperature value T(maximum). Such a predetermined temperature value T(maximum) is typically determined by the height and/or weight of a potential user, thereby tailoring the hot water temperature to better approximate the requirements or preferences of the user. The T(maximum) value can be specifically programmed for a unique individual user or a default T(maximum) value is selected when a general category user is detected. Detection of a unique individual user or general category user is accomplished via the use of at least one physical attribute sensor. The physical attributes of the potential hot water user detected are primarily based on the user's height, weight, or combinations thereof.

In preferred tank-less embodiments, the water that emanates from the hot water output location is thermally conditioned by a hot water heating system having both an internal and an external recirculation loops or flow lines. The internal recirculation loop's primary function is to get the heating system containing the burner activated and up to a predetermined operating temperature. The external recirculation loop's primary function is to prime the hot water line with hot water, thereby flushing out the once hot water which has now cooled. Both internal and external recirculation loops help to reduce temperature fluctuations and delays in hot water delivery.

In one embodiment of the present invention, the internal recirculation loop is first activated and then followed by the automatic activation of the external recirculation loop when a potential hot water user is detected. Attribute detecting sensors are selected and configured to detect physical characteristics or attributes of a potential hot water user such as height, weight, combinations thereof, and the like, thereby creating a user signature. User identifying signatures can be comprised of a single attribute, or combination of user attributes and/or spatiotemporal detection characteristics to better ensure accurate user detection. A signature, based on certain physical characteristics of a user, can be used to detect a unique individual user as well as identifying a user as a member of a general category, such as an adult, child, pet, and the like. A potential hot water user's signature, once detected, would result in the generation of a hot water heater pre-activation signal, followed by a hot water heater pre-activation sequence to facilitate hot water delivery to the user.

In another embodiment, heating is initiated by a pre-programmed schedule, wherein the pre-programmed schedule preferably reflects the time periods of a day in which hot water demands are expected.

It is a primary object of the present invention to provide a hot water system which is capable of anticipating usage and prepares hot water ready for use with minimal water and power wastage.

It is another object of the present invention to provide a control system capable of managing false triggering by filtering out such detections (i.e. the discarding of entities that are not direct hot water users such as pets, insects, and the like).

It is another object of the present invention to provide a user activated hot water system that is capable of detecting a dead-heading condition and reacting to this condition to reduce power wastage.

It is a further object of the present invention to provide a user activated hot water system that is capable of detecting a trickle flow and reacting to the heating demand associated with this trickle flow.

It is a further object of the present invention to provide a user activated hot water system that is capable of preventing scale formation on internal surfaces of the fluid conductors.

It is a further object of this invention to provide a user activated hot water heater and control system that is economical from the viewpoint of the manufacturer and consumer, is susceptible of low manufacturing costs with regard to labor and materials, and which accordingly is then susceptible of low prices for the consuming public, thereby making it economically available to the buying public.

Whereas there may be many embodiments of the present invention, each embodiment may meet one or more of the foregoing recited objects in any combination. It is not intended that each embodiment will necessarily meet each objective.

Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

In this respect, before explaining at least one embodiment of the invention in detail, it is to be understood that the invention is not limited in its application to the details of construction and the arrangements of the components set forth in the following description or illustrated in the drawings. The present invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the conception regarded as the present invention.

PARTICULAR ADVANTAGES OF THE INVENTION

The present invention provides users of hot water with several advantages. Preferred embodiments of the present invention utilize both internal and external recirculations that are user activated to provide substantially instantaneous hot water delivery upon request. Additionally, preferred embodiments incorporating a temperature based water flow detection system will continue to reliably provide continuous low flow levels of hot water or trickle flow. This is accomplished by the sensing of water temperature at two or more points in the water delivery system as opposed to the less sensitive method of directly detecting water flow. A dead heading condition occurs when the external recirculation ceases as it is blocked, causing the heating process through the external recirculation flow line impossible. The present invention is capable of detecting a dead-heading condition and reacting to the condition by diverting flow to the internal recirculation flow line or by ceasing the pump, thereby reducing power wastage.

The user activated portion of the present invention will provide an energy savings resulting from the as needed smart activation of internal and/or external recirculation systems. Additionally, in preferred embodiments incorporating tank-less water heaters, the hot water maximum temperature, T(maximum) is dependent on the preference setting or default value of the detected general category user or unique individual user. The user-dictated control of hot water heater T(maximum) value will not only further increase energy savings, but additionally provide a safety feature that helps protects heat sensitive people such as children, the elderly and the like from potential water burns.

In addition, the present invention differs from conventional recirculations in that the present invention permits dynamic modification of internal versus external recirculation by providing an adjustable valve in the internal recirculation loop. The present invention further differs from conventional recirculations in that the present invention takes advantage of the adjustable valve so that the internal and external recirculation flowrate ratio is modifiable on-the-fly.

BRIEF DESCRIPTION OF THE DRAWINGS

The invention will be described by reference to the specification and the drawings, in which like numerals refer to like elements, and wherein:

FIG. 2B illustrates a state diagram of the control scheme of the present invention depicting a method by which a trickle flow and a dead-heading condition are detected and responded to.

Figure 1:
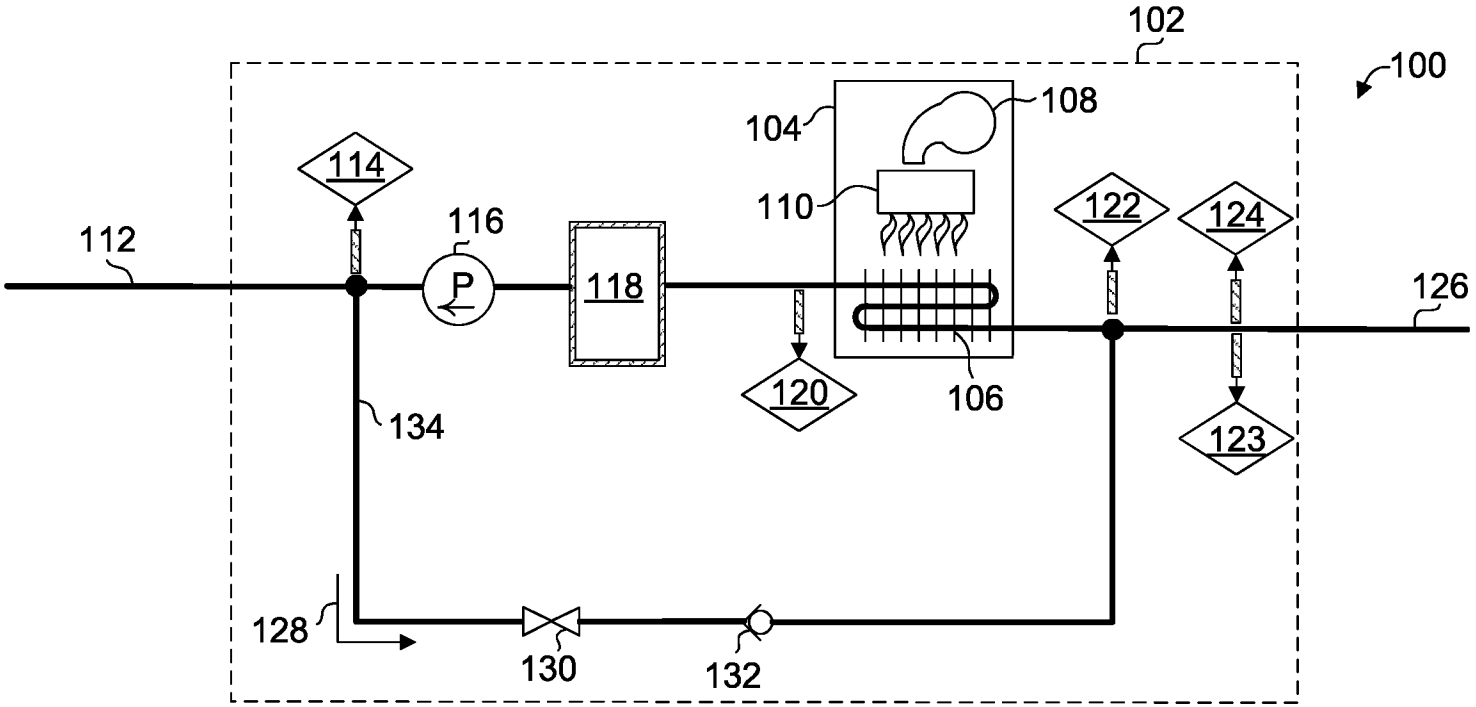
FIG. 1 illustrates a schematic diagram of a preferred tank-less hot water system having an internal recirculation loop and a temperature based water flow detection system.

The drawings are not to scale, in fact, some aspects have been emphasized for a better illustration and understanding of the written description.

SPECIFICATION TERM DEFINITIONS AND CONVENTIONS USED

The user activated hot water heater and control system discussed throughout this disclosure shall have equivalent nomenclature, including: the system, the device, the apparatus, the present invention, or the invention. Additionally, the term "exemplary" shall possess a single meaning; wherein the sole definition pertains to serving as an example, instance, or illustration.

In order to help facilitate the understanding of this disclosure, a parts/features list numbering convention has been employed. The first digit in three digit part numbers refers to the Figure number where the part was first introduced, or is best depicted. Likewise, in four digit part numbers, the first two digits refer to the Figure number where the part was first introduced, or is best depicted. Although this disclosure may at times deviate from this convention, it is the intention of this numbering convention to assist in an expeditious comprehension of this application.

PARTS/FEATURES LIST

100. tank-less hot water system with internal recirculation loop
102. tank-less hot water heater
104. heating system
106. heat exchanger
108. blower
110. burner
111. thermostatic valve package
112. hot water outlet
113. cold water outlet
114. T(water outlet), Tout
116. recirculation pump
118. buffer tank
120. T(heat exchanger), Thex
122. T(recirculation), Trec
123. T(inlet), Tinlet
124. flow sensor
126. water inlet
128. internal recirculation flow
130. solenoid valve
131. thermostatic valve of thermostatic valve package 111
132. check valve
134. internal recirculation loop or flow line
200. tank-less hot water system with internal and external recirculation loops
201. main flow line
202. check valve
203. check valve of thermostatic valve package 111
204. external recirculation flow
205. external recirculation flow through thermostatic valve package 111
206. external recirculation loop or flow line
207. external recirculation loop using thermostatic valve package 111
208. "Active" state
209. "Standby" state
210. "Trickle Flow" state
211. "External Recirculation" state
212. length between heating system and point of demand
214. holding tank
216. portion of fluid conductor between the input point where the main flow line and the recirculation flow line meet and the heat exchanger
300. exemplary flow chart (showing present invention being activated by a child user)
302. physical attribute sensor(s) (detection of a potential user)
304. potential user identified (as a child user by signature comparison by electronic control unit (ECU))
306. ECU (generates proper pre-activation signal for a child)
308. pre-activation sequence initiated (based on pre-activation signal instructions)
310. hot water timely provided (for child user not exceeding predetermined T(maximum) for a child
400. exemplary block diagram of a user activated hot water control system
402. interface, function includes data input means for ECU
404. ECU
406. physical attribute sensor(s)
408. hot water heater (tank-less)
410. signal receiver for hot water heater
412. hot water heater system controller
414. pre-activation signal
416. hot water heater pre-activation sequence

DETAILED DESCRIPTION

In the following description, several embodiments are introduced relating to a user activated hot water heater and control system of the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose.

Figure 2:
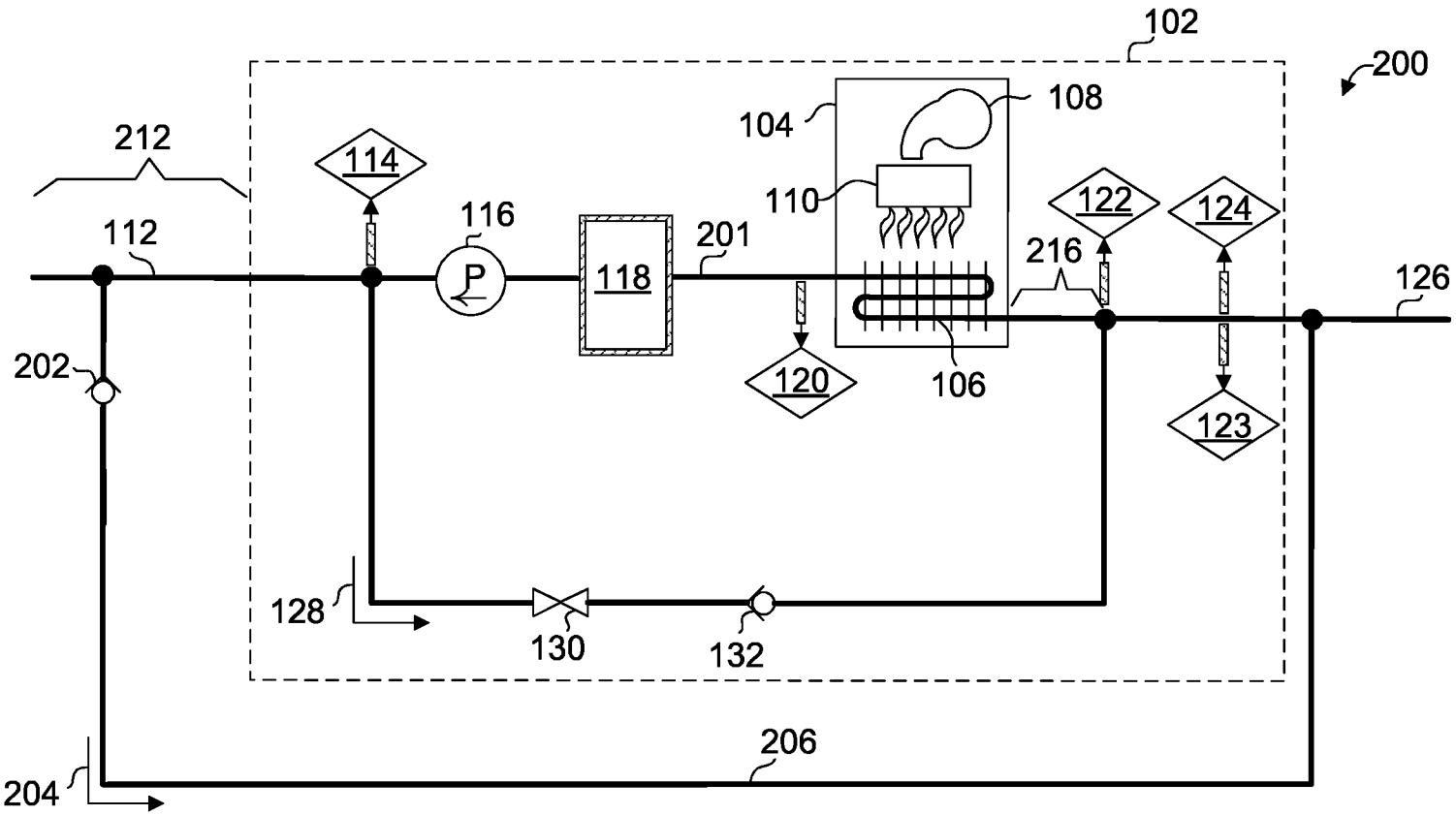
FIG. 2 illustrates a schematic diagram of a preferred tank-less hot water system having both an internal and an external recirculation loop and a temperature based water flow detection system.

FIG. 1 depicts a tank-less hot water system 100 with an internal recirculation loop. FIG. 2 depicts a tank-less hot water system 200 having both an internal and an external recirculation loop. Both systems depicted in FIGS. 1 and 2 possess internal recirculation loop-supporting components that enable internal recirculation flow 128. Supporting components include pump 116, adjustable valve 130 capable of modifying the flowrate of the internal recirculation flow, check valve 132, heating system 104, buffer tank 118, and flow sensor 124. Heating system 104 is comprised of blower 108, burner 110, and heat exchanger 106.

Referring to FIG. 2, an external recirculation loop 206 enables external recirculation flow 204 through tank-less hot water system 200. The loop comprises a check valve 202 which prevents the flow of cold water directly from inlet 126 to outlet 112. In one embodiment, the adjustable valve 130 is a solenoid valve. In another embodiment, the adjustable valve 130 is a proportional valve. The length 212 between the heating system 104 and point of demand can be quite large (for example 100 ft. in a residential setup). Without external recirculation, the length of water contained in this length 212 would cool down and delay hot water delivery when the next demand is requested as this length of cool water would need to be pushed out before the heated portion arrives at the point of demand.

Both systems depicted in FIGS. 1 and 2 possess a temperature based water flow detection system and its supporting temperature sensing apparatus which provide: T(water outlet) or Tout 114, T(heat exchanger) or Thex 120, T(recirculation) or Trec 122 and T(water inlet) or Tinlet 123. The temperature based water flow detection system is capable of detecting low or trickle flow conditions that typical flow sensors 124 are incapable of detecting. An example typical trickle flow situation occurs during shaving, where a hot low water flow is desired. The temperature based water flow detection system is primarily based on detecting a thermal differential between at least two points in the main flow line where the two points straddle a heat retaining device, such as the buffer tank 118. Exemplary two points include Tout 114 and Thex 120 as well as Tout 114 and Trec 122 as depicted in FIGS. 1 and 2. For example, during a period in which the water heater is not in active use, a trickle flow that is undetectable by flow sensor 124 tends to cause Thex 120 and Trec 122 to drop significantly more rapidly than Tout 114 as Trec 122 experiences incoming cold water while Thex 120 experiences residual heat from the heating system 104 and incoming cold water. Tout 114, in contrast, experiences residual heat from the heat system 104 and the buffer tank 118 which causes Tout 114 to remain quite high relative to Thex 120 and Trec 122 at the beginning of a trickle flow demand. In another embodiment, a trickle flow demand is detected by the rate at which Tinlet 123 falls. In the present invention, water inlet 126 is disposed at a level higher than the hot water outlet 112. As such, a shutdown in the demand at hot water outlet 112 causes the output of Tinlet 123 to increase as heat rises. When a trickle flow occurs, fresh cold water enters at the water inlet 126 and causes the Tinlet 123 temperature reading to fall.

Referring again to FIG. 1, tank-less hot water heater 102 possesses a water inlet 126 that is typically connected to a municipal water supply, well water, or the like. Hot water exits hot water heater 102 via hot water outlet 112. Tank-less hot water heater 102 possesses an internal recirculation loop 134; the loop provides a relatively short closed loop water circulation path located within tank-less hot water heater 102 enclosure. A water heater pre-activation sequence is activated by a potential hot water user as delineated in the flow diagram of FIG. 3. The water heater pre-activation sequence is dependent on the water heater's configuration with possible types of activations including activating internal recirculation flow 128 and/or activating external recirculation flow, as well as setting the maximum allowable hot water temperature T(maximum), where T(maximum) corresponds to a predetermined maximum temperature level associated with the type of potential user detected (e.g. child, adult, and so forth).

FIG. 2 illustrates a schematic diagram of a preferred tank-less hot water system 200 including an external recirculation loop 206. A typical launch sequence activated by a potential child hot water user is depicted in the exemplary flow chart 300 of FIG. 3 wherein internal recirculation flow 128 is activated. In another embodiment, the launch sequence is initiated by a pre-programmed schedule, wherein the pre-programmed schedule preferably reflects the time periods of a day in which hot water demands are expected. Once the water comprising internal recirculation flow 128 reaches the predetermined temperature, external recirculation flow 204 subsequently activates, thereby substantially preheating the remainder of the targeted plumbing system to the same predetermined temperature.

The novel user activated portion of the present invention provides an energy savings resulting from the as needed smart activation of internal and/or external recirculation systems as well as providing a safety feature that helps protects heat sensitive hot water users such as children, the elderly and the like from potential water burns by the real-time adjustment of T(maximum).

Figure 2A:
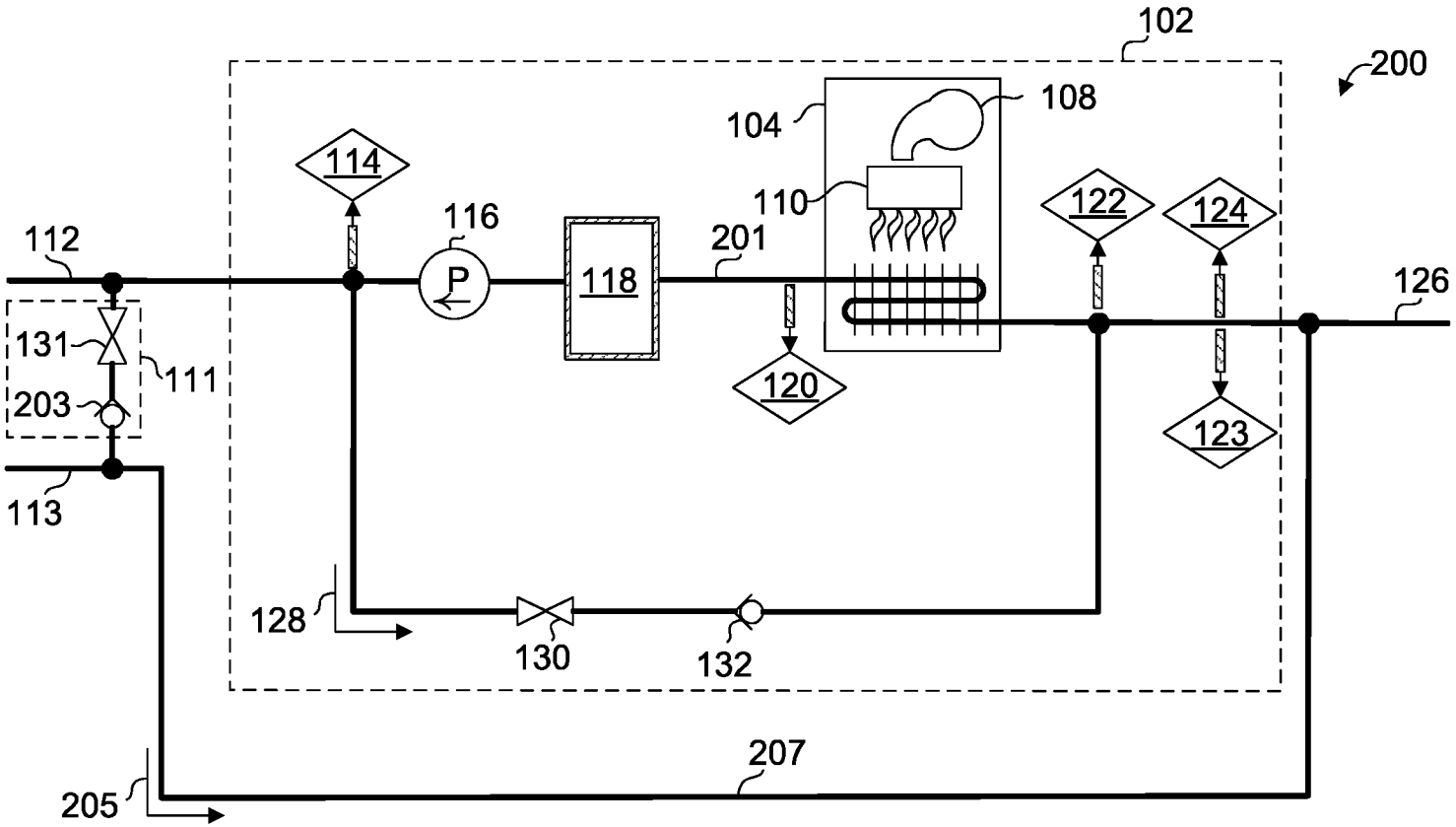
FIG. 2A illustrates a schematic diagram of a preferred tank-less hot water system having both an internal and an external recirculation loop and a temperature based water flow detection system, wherein the external recirculation loop uses a thermostatic valve.

In addition to a dedicated external recirculation loop 206 of FIG. 2, the Applicants propose another type of external recirculation loop which takes advantage of existing warm and cold water outlets. In such configurations, installation of dedicated return line can be avoided, thereby minimizing the expenses in hardware and installation. FIG. 2A illustrates a schematic diagram of a preferred tank-less hot water system having both an internal and an external recirculation loop and a temperature based water flow detection system. A thermostatic valve package 111 is fluidly disposed between the hot water outlet 112 and a cold water outlet 113 such that an external recirculation loop 207 is formed. The thermostatic valve package 111 comprises a thermostatic valve 131 and a check valve 203. A commercially available thermostatic valve package typically includes a thermostatic valve and check valve. The thermostatic valve is disposed in an open state until the temperature of the flow through it rises to a threshold. This threshold is typically user adjustable and typically set at about 80 to 120 degrees Fahrenheit. In a preferred embodiment, the threshold is set at about 98 degrees Fahrenheit. When necessary, an external recirculation flow 205 is fully enabled in the external recirculation loop 207 by de-energizing or closing the solenoid valve 130.

Page 28 of Navien Gas Water Heater Owner's Operation Manual (for Models NR-180(A), NR-210(A), NR-240(A), NP-180(A), NP-210(A) and NP-240(A)), hereinafter Navien, illustrates a schematic diagram of a conventional tank-less hot water system showing an internal and an external recirculation loop, wherein the selection of the type of recirculation is made via a manual DIP switch setting and physically turning a 3-way valve to a desired position. At installation, the 3-way valve is manually set such that either an internal recirculation loop or an external recirculation loop is enabled, but not both. Internal recirculation is effected with the pump which draws water flow from the water tank to the pump via the 3-way valve. External recirculation is effected with the pump which draws water flow from the water tank through the hot water outlet and returns via the cold water inlet to the pump via the 3-way valve. In contrast to the present invention, conventional internal or external recirculation is selected manually with a DIP switch setting and a 3-way valve at time of installation. In the present invention however, as depicted in FIG. 2 or 2A, a solenoid valve 130 is advantageously disposed in the internal recirculation loop. A buffer tank 118 is disposed upstream of the Tout 114 temperature sensor and downstream of the Thex 120. When the solenoid valve 130 is energized, the solenoid valve 130 is disposed in an open state. Referring to FIGS. 2 and 2A, while the solenoid valve 130 is disposed in this position and when the pump 116 is turned on, an internal recirculation flow 128 and an external recirculation flow 205 are created. The relative size of the internal and external recirculations is adjustable by varying the pressure drop imparted by the internal recirculation circuit. The pressure drop experienced in the internal recirculation flow is modifiable by altering the valve flow coefficient Cv of the solenoid valve 130, the spring rate of the check valve 132 and/or the type and size of the internal recirculation piping, etc. In one preferred embodiment, the flowrate ratio of the internal and external recirculations ranges from about 52:48 (1.1) to 95:5 (19). For example, when Cv is increased, the pressure drop is reduced, thereby increasing the internal to external recirculation flowrate ratio. Decreasing the spring rate of the check valve 132 and the size of the internal recirculation piping produce the same effect of decreasing the pressure drop in the internal recirculation loop. When exclusive external recirculation is desired, the solenoid valve 130 is de-energized so that the solenoid valve 130 is closed to prevent internal recirculation. By positioning a solenoid valve 130 in the internal recirculation loop and a buffer tank 118 upstream of the Tout 114 temperature sensor and downstream of the Thex 120 temperature sensor and lowering the pressure drop in the internal recirculation loop, internal or external recirculation can be selected on-the-fly. In one embodiment, the pump 116 is a variable speed pump capable of modulating the flow rate in the main flow line 201, therefore affecting the internal and external recirculation flowrates.

In contrast to conventional recirculations as depicted in Navien, the present invention as depicted in FIGS. 2 and 2A permits simultaneous internal and external recirculation, thereby enabling mixing of heated water with cool water in the internal and external recirculation loops in a more efficient manner resulting in decreased delay of delivery of hot water at the desired temperature.

In addition, the present invention differs from conventional recirculation as depicted in Navien in that the present invention permits dynamic modification of internal versus external recirculation by disposing the buffer tank 118 upstream from Tout 114 and downstream from Thex 120 and providing a solenoid valve 130 in the internal recirculation loop. The present invention further differs from conventional recirculation as depicted in Navien in that the present invention takes advantage of a solenoid valve so that the internal and external recirculation flowrate ratio is modifiable on-the-fly.

In addition to the foregoing advantages, the present invention comprises a pump arrangement which can readily be used for either external recirculation with a dedicated return line as depicted in FIG. 2 or external recirculation with a thermostatic valve bridging the heated and cold flow lines as depicted in FIG. 2A.

In one embodiment (not shown), Thex 120 is used to detect pump 116 or solenoid valve 130 failure. If internal recirculation fails due to a dysfunctional pump, solenoid valve, wiring or relay, Thex 120 reading will fail to rise 5 degrees Fahrenheit after 5 seconds of the heating operation of the burner 110. When such failure occurs, the burner 110 is shut down.

Figure 2B:
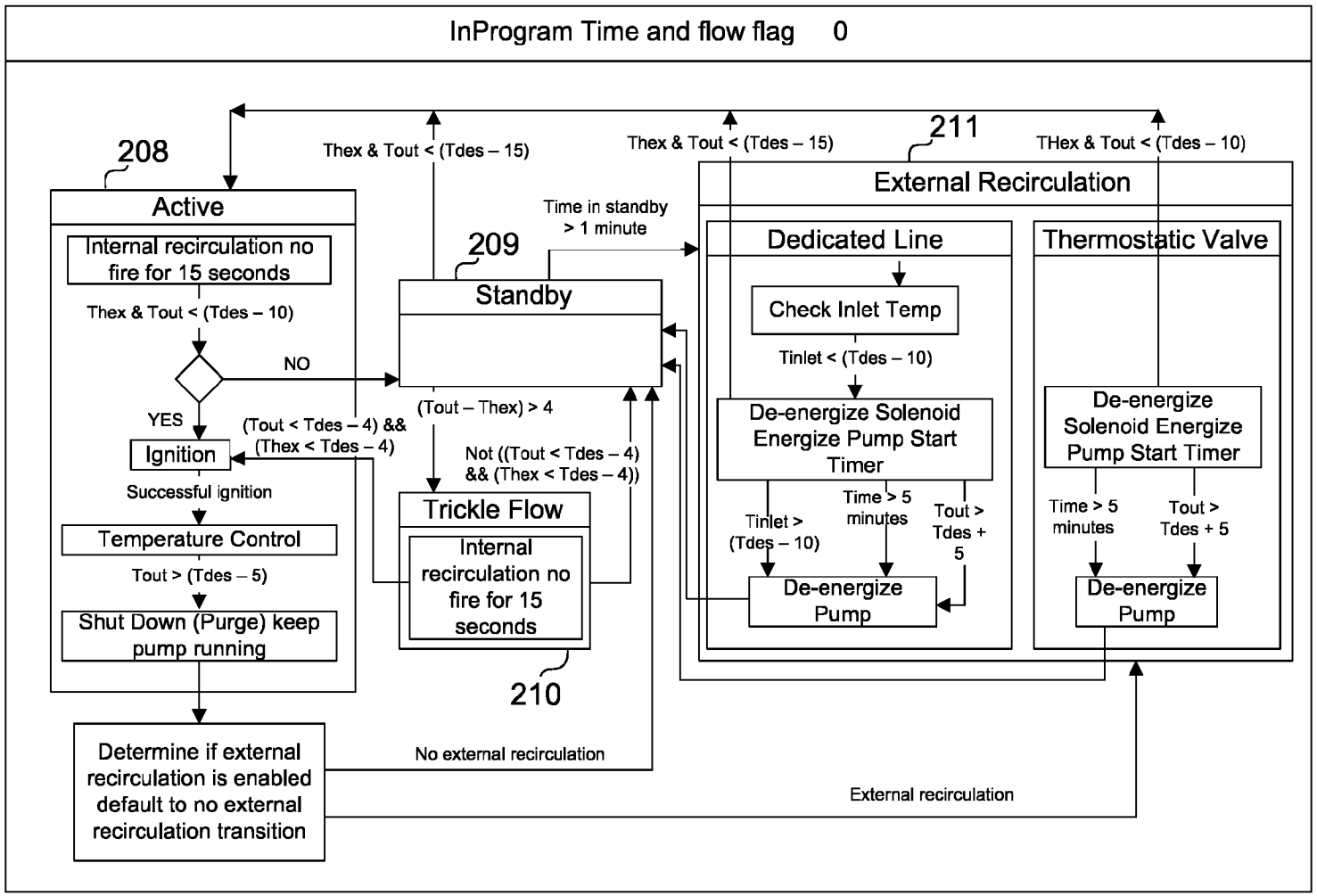

FIG. 2B illustrates a state diagram of the control scheme of the present invention depicting the method by which trickle flow and a dead-heading condition are detected and responded to. As disclosed elsewhere in this specification, conventional hot water heater systems lack a reliable solution to detect and respond to trickle flow demands. In a conventional system, a flow sensor is used to detect a hot water demand. Unfortunately, typical flow sensors are able to detect only flows greater than minimum flow threshold of 0.5 gpm. In such conditions, getting a heated trickle flow becomes a problem as the flow sensor would not detect a demand under the minimum flow threshold and trigger a heating response. The Applicants discovered a novel method which detects a trickle flow demand. FIG. 2B depicts a temperature based control scheme used in cooperation with a flow based control scheme (not shown). Referring to FIGS. 2, 2A and 2B, when a hot water demand exceeds the minimum detection threshold of the flow sensor 124, the flow based control scheme is employed. Such a scheme typically employs a Proportional Integral Derivative PID controller, wherein heating is directly proportional to the size of a hot water demand. However, if the demand lies below the minimum detection threshold, conventional water heating systems will fail to heat a trickle flow. Referring to FIG. 2B, the temperature based controller is treated as a state machine comprising the "Active 208," "Standby 209," "Trickle Flow 210" and "External Recirculation states 211." In the present invention, internal and external recirculation are initiated based on three criteria, i.e., (1) preprogrammed time is now, (2) a flow based heating occurred for a predetermined amount of time in the past and (3) a user activated trigger as disclosed elsewhere in this specification. If (2) is initiated, the routine depicted in FIG. 2C called "FastStart" is executed.

In the present invention, trickle flow can only be detected if the trickle flow detection scheme is activated with its internal recirculation loop already at approximately the desired output water temperature Tdes. In order to obtain a representative temperature within the internal recirculation loop, a routine called "stirring the pot" is used. The "Stirring the pot" routine involves turning on internal recirculation for a predetermined amount of time without firing the burner 110. In one embodiment, this routine is run once every minute.

Figure 2C:
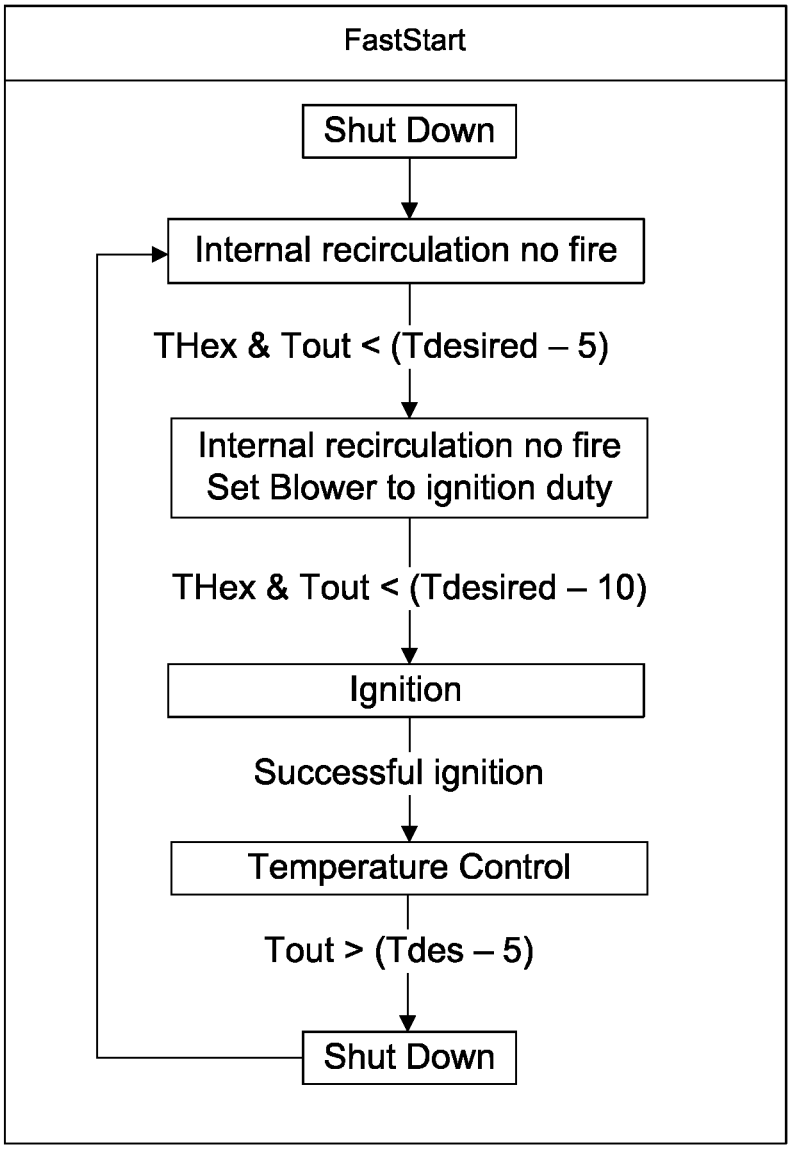
FIG. 2C illustrates a flowchart of a control scheme executed for pre-heating the volume of water held in the internal recirculation loop anticipating the next usage of a water heater.

Referring to FIGS. 2, 2A and 2C, the "Stirring the Pot" routine is executed prior to examining the Thex and Tout temperatures. If Thex 120 and Tout 114 are at a first predetermined number of degrees Fahrenheit below the desired output temperature Tdes, the "Stirring the Pot" routine is run once more prior to examining Thex 120 and Tout 114 and the blower is set to a speed corresponding to ignition duty in anticipation of an ignition of the burner. If Thex 120 and Tout 114 are at a second predetermined number of degrees Fahrenheit below the desired output temperature, the burner is ignited. The burner is shut down when the output temperature is within a third predetermined number of degrees Fahrenheit from the desired temperature.

Referring to FIG. 2B, when Thex 120 and Tout 114 have come within a fourth predetermined number of degrees Fahrenheit within the desired output temperature Tdes, the temperature based control scheme enters the "Standby 209" state. If Tout 114 is greater than Thex 120 by more than a fifth predetermined number of degrees Fahrenheit, the temperature based control scheme enters the "Trickle Flow 210" state due to an indication that a trickle flow has occurred. In one embodiment, the fifth predetermined number is about 4. While in this state, the "Stirring the Pot" routine is activated. If Tdes is greater than Thex 120 and Tout 114 by more than a sixth predetermined number of degrees Fahrenheit, the temperature based control scheme enters the "Active 208" state where the burner is ignited for heating, otherwise the temperature based control scheme returns to the "Standby 209" state. In one embodiment, the sixth predetermined number of degrees is about 4.

Referring again to FIGS. 2 and 2A, the use of external recirculation in combination with a thermostatic valve (as shown in loop 207) or a dedicated return loop 206 is not without peril. A thermostatic valve installed for such an application is typically an independent valve which is operably independent from the water heating system to which it is connected. As such, the decision to turn on external recirculation is not based on the state of the thermostatic valve. A closed thermostatic valve causes a blocked passageway for the external recirculation circuit. While the thermostatic valve 131 is closed, external recirculation flow 205 cannot occur. In a flow based system, dead heading is avoided by stopping the pump 116 when a flow sensor senses no flow within a predetermined amount of time from the start of a pump operation. Applicants have discovered a novel temperature based approach to minimize dead heading which occurs when external recirculation is attempted with the thermostatic valve 131 closed while ensuring that recirculation is not ceased prematurely. In a conventional water heating system, dead heading is typical left untouched until the pump of the system has terminated due to the expiration of a timer. Such practice is wasteful as dead heading or lack of circulation of water in the external recirculation flow line of a heater system does not cause the water in the external recirculation flow line to be heated. Referring to both FIGS. 2A and 2B, when the controller scheme is in the "External Recirculation state 211," the pump 116 is programmed to be turned on for a predetermined duration or until dead heading has been detected.

Referring to FIG. 2B, while in the Active state, internal recirculation is effected by turning on the pump 116 and opening the solenoid valve 130 and the burner is turned on to add heat to the internal recirculation flow 128 and to make the internal recirculation flow temperature uniform. Pulse firing is used to allow low rate of heat addition. Exemplary firing rate ranges from 1000 to 12000 BTU. Internal recirculation is initiated by energizing the solenoid valve 130. The burner is turned on to add heat to the internal recirculation flow. If both Thex 120 and Tout 114 are within a predetermined threshold of the desired temperature, the internal recirculation is terminated by turning off the pump 116 prior to de-energizing the solenoid valve 130. External recirculation is attempted by de-energizing (or closing) the solenoid valve 130 and keeping the pump 116 running. The act of turning off the pump 116 prior to de-energizing the solenoid valve 130 reduces water hammer. If the solenoid valve 130 is de-energized prior to de-energizing the pump 116, then the internal recirculation comes to a sudden stop, causing the flow to "hammer". In one embodiment, the pump 116 is de-energized for a second for the internal recirculation flow to stop due to friction loss prior to de-energizing the solenoid valve 130.

Upon entering the External Recirculation state 211 and while in this state, both Thex 120 and Tout 114 are compared to the desired output temperature Tdes after a first predetermined amount of time has elapsed. If either Thex 120 or Tout 114 is at least a seventh predetermined number of degrees Fahrenheit lower than the desired outlet temperature Tdes, the control scheme transitions from the External recirculation state to the Active state where internal recirculation again takes place. For this transition to function, Thex 120 must be positioned upstream of the buffer tank 118 and Tout 114 must be positioned downstream of the buffer tank 118. In an embodiment with a dedicated external recirculation flow line, the seventh predetermined number is about 15. In an embodiment equipped with a thermostatic valve, the seventh predetermined number is about 10.

In an external recirculation system having a dedicated return line, external recirculation is terminated by turning off the pump 116 when Tinlet 123 falls within an eighth predetermined number of degrees Fahrenheit from the desired output temperature Tdes. In one embodiment, the eighth predetermined number is about 10.

In an external recirculation system having a thermostatic valve or a dedicated return line, external recirculation is terminated by turning off the pump 116 when Tout 114 exceeds the desired output temperature Tdes by a ninth predetermined number of degrees Fahrenheit. In one preferred embodiment, the ninth predetermined number was found to be advantageous at 5 as this setting was capable of preventing false triggers to exit the External Recirculation state 211 while sufficiently sensitive to detect a dead heading condition. For dead heading detection to occur, Tout 114 must be positioned immediately downstream from the pump 116. In one embodiment, there is a mere 2 inches of fluid conductor connecting the pump 116 and Tout 114.

Figure 2D:
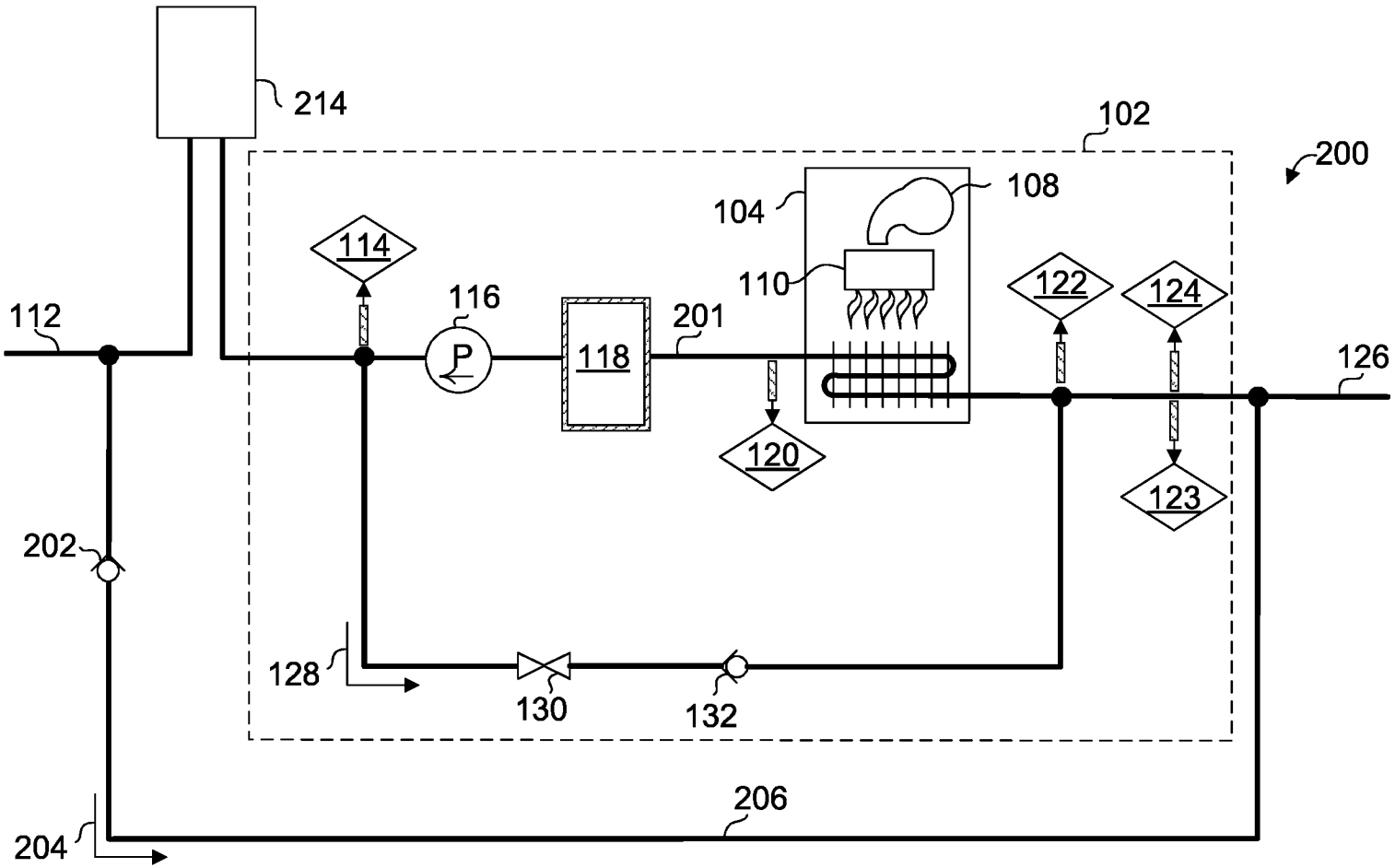
FIG. 2D illustrates a schematic diagram of a preferred tank-less hot water system having both an internal and an external recirculation loop and a holding tank.

FIG. 2D illustrates a schematic diagram of a preferred tank-less hot water system having both an internal and an external recirculation loop and a holding tank 214. The Applicants discovered that by offering a holding tank disposed externally to the tank-less hot water system, the ability to service applications with high peak loads for a short duration is improved. This solution reduces the initial cost of such applications by eliminating the need for multiple tank-less hot water systems coupled together to meet high peak loads. In this configuration, a holding tank 214 is fluidly connected to the output of the tank-less hot water system. Upon cessation of a hot water demand, the holding tank 214 holds a relatively large volume of hot water as compared to the volume held by the entire length of fluid conductors of a hot water system without the holding tank 214. With external recirculation, the volume of water in the entire length of fluid conductors including the holding tank 214 is heated to anticipate usage, thereby minimizing the delay to produce hot water in response to high peak loads. A check valve 202 is disposed in the external recirculation loop to prevent flow of cold water from the water inlet 126 to the hot water outlet 112.

Figure 3:
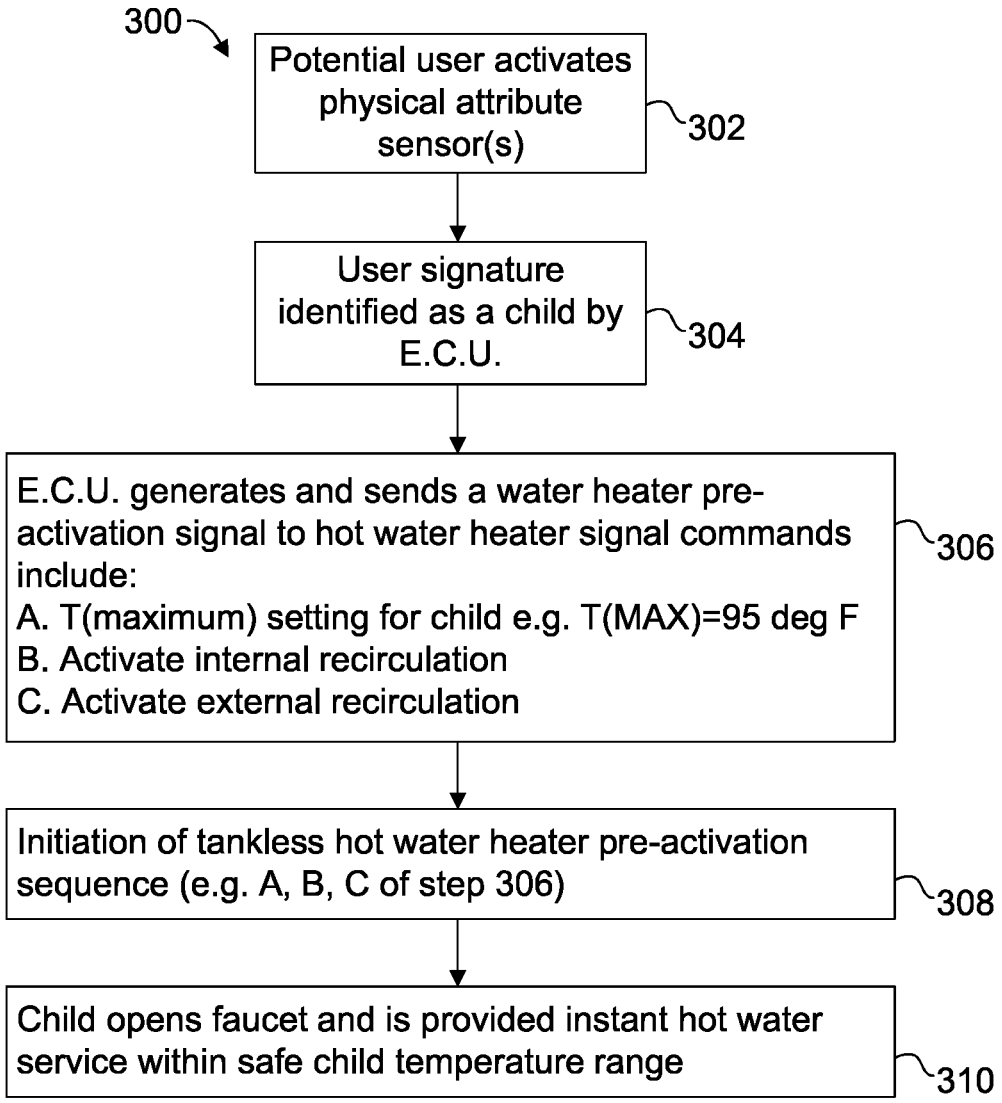
FIG. 3 illustrates an exemplary flowchart delineating the triggering of a user activated hot water heater and control system where the potential hot water user is a child.

FIG. 3 illustrates exemplary flow chart 300 using the tankless hot water heater depicted in FIG. 2 or FIG. 2A, having both an internal and an external recirculation loops. A user activated hot water control system is adapted to the hot water heater, wherein the user, which in this case is a child, generates a water heater pre-activation signal when a predetermined physical attribute signature of a potential user is detected.

Exemplary flow chart 300 begins with block 302 where the physical attribute sensor(s) are acting upon a potential child user, wherein predetermined physical attributes are such as height and weight are detected. In block 304, the child user's physical attribute signature is identified by an ECU. In block 306, the ECU sends a pre-activation signal to the water heater, wherein the signal contains information regarding maximum safe temperature for a child T(maximum) value, along with water heater pre-activation sequence (e.g. calling for internal and external recirculation at T(maximum) setting). In block 308 the commands contained in the pre-activation signal are launched by the hot water heater in preparation for the child user. Finally, in block 310, the child user demands hot water; wherein hot water is delivered substantially free from temperature fluctuations and/or delays; wherein delays are measured from the moment of hot water demand, e.g. turning on the faucet, to the point of receiving hot water at the predetermined target temperature.

Figure 4:
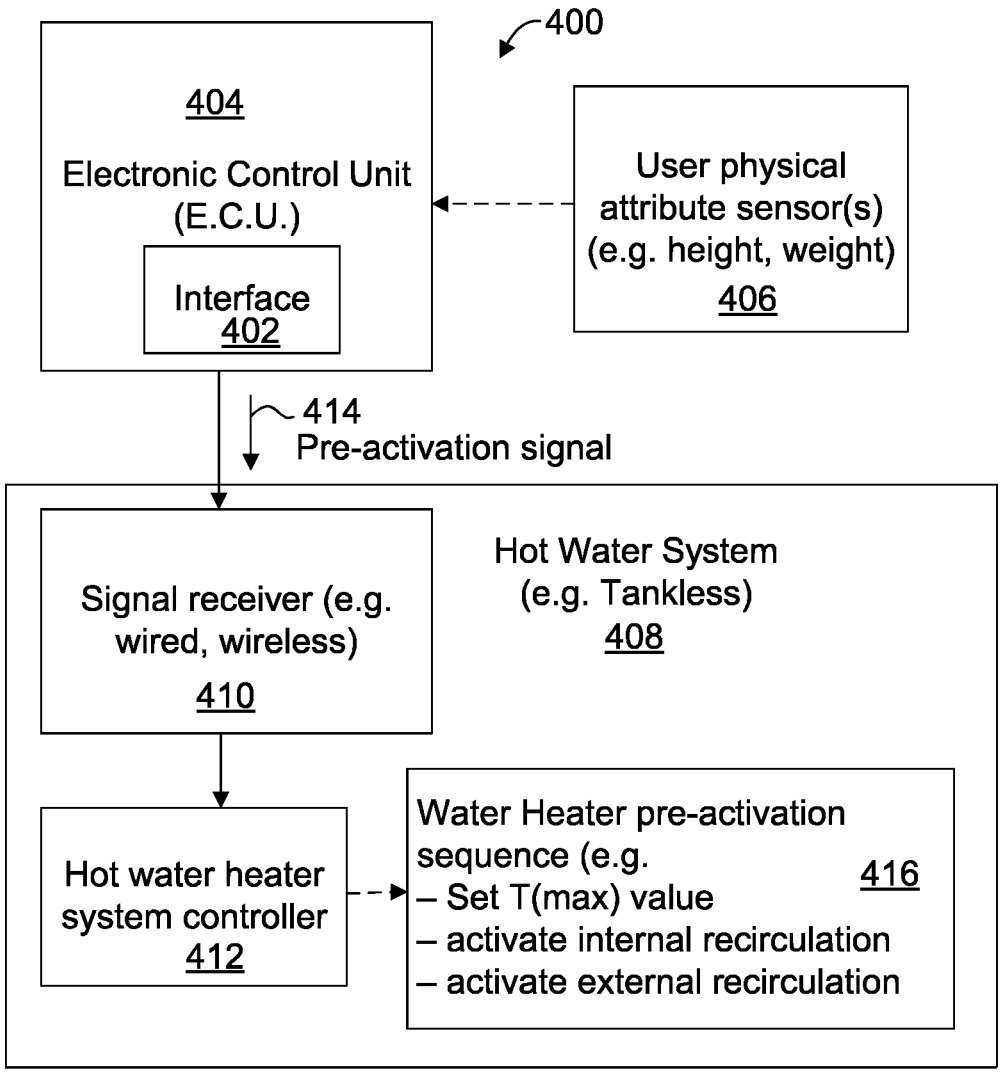
FIG. 4 depicts a general block diagram showing basic signal logic relationships among the electronic control unit, the physical attribute sensor(s), and the hot water system.

FIG. 4 illustrates a general block diagram 400 showing a user activated hot water control system and its cooperative relationship to a tankless hot water system. Contained within ECU 404, for exemplary purposes, is interface 402. Interface 402 provides a data input means to electronic control unit 404. Inputted data can replace and/or supplement pre-existing default data present. Exemplary input data includes: range values defined in zones 1 through 4 shown in FIG. 5 and FIG. 6; height values of users1 through user4 depicted in FIG. 6, T(maximum) settings, and the like. Other parameters that are controllable or adjustable such as: sampling rate of the sensor(s), sensitivity adjustments, component calibration, and the like, are accessible via interface 402. Although not so limited, a touch screen type interface 402 offers many advantages to the user and is a preferred embodiment.

Electronic control unit 404 performs several signal based tasks including comparisons between inputted or default values and sensor(s) measured values, for user signature comparison; management of control and driving signals to both physical attribute sensor(s) 406, as well as signal receiver 410 for hot water system 408. In summary, the Electronic control unit 404 behaves like a controlling computer system comprised of RAM and ROM type memory, a CPU, an interface, an operating system, and the like. The methods and associated hardware for detecting and comparing sensor signals, along with activating signal controllable mechanisms such as blowers, burners, and valves is a well known, mature technology and implementation would not present an undue burden to those versed in the art. Such conventional techniques are disclosed in U.S. Pat. Nos. 5,829,467 and 6,892,746, which are incorporated in their entirety herein by reference.

In one embodiment, once a physical attribute signature is identified and confirmed by electronic control unit 404, the unit sends a pre-activation signal 414 to signal receiver 410 that functions as a signal interface for hot water heater 408. It is understood that a pre-activation signal 414 can be transmitted using a hard wired connection as well via a wireless means. The pre-activation signal 414 containing hot water heater 408 specific information (e.g. maximum safe temperature T(maximum) for detected user, water heater pre-activation sequence—internal and external recirculation parameters) received by signal receiver 410 is then processed and commands corresponding to the specific information are delivered to hot water heater system controller 412. In other embodiments, the storage of maximum safe temperature T(maximum) and the like, can reside within hot water heater 408. These commands are incorporated in the pre-activation sequence launched by the hot water heater to prepare for hot water delivery.

The typical steps a user activated tank-less hot water system would go through begins with detecting a potential user and generating a physical attribute signature corresponding to the potential user. The step is then followed by comparing and selecting the user's generated physical attribute signature to a user signature data base, and selecting a best match user signature that best aligns with the user's physical attributes. At this point, the system retrieves a hot water pre-activation sequence corresponding to the best match or closest user signature. Finally, the last step involves activating the hot water pre-activation sequence for the user activated tank-less hot water system, wherein temperature fluctuations and delays in hot water delivery are reduced.

Physical attribute sensor(s) 406 is comprised of at least one sensor capable of detecting and measuring at least one physical attribute of a potential hot water user. The use of more than one sensor has advantages, e.g. reduction is false triggering, and is therefore a preferred embodiment. Available sensors include: heat (IR) sensors, pressure (weight) sensors, light or laser based sensors, proximity sensors (e.g. capacitance based), vibration sensors, ultrasonic sensors, or any combination thereof. In preferred embodiments, a sensing system will provide a reliable, safe, non-obtrusive, hardware and associated methods of detection. Additionally, relatively inexpensive, easily installed sensing systems are considered desirable attributes of preferred embodiments. Most of the aforementioned sensing systems can be designed to decipher motion as well as distance via the analysis of the parameter being detected. One such preferred sensor is the ultrasonic based sensing system. The following is an excerpt from a published lecture available from Brown University of Providence, R.I., reviewing the fundamentals of ultrasonic sensing.

Ultrasonic Acoustic Sensing

Ultrasonic sensors are often used in robots for obstacle avoidance, navigation and map building. Much of the early work was based on a device developed by Polaroid for camera range finding. From the Hitechnic Ultrasonic Sensor web page we learn that their "ultrasonic range sensor works by emitting a short burst of 40 kHz ultrasonic sound from a piezoelectric transducer. A small amount of sound energy is reflected by objects in front of the device and returned to the detector, another piezoelectric transducer. The receiver amplifier sends these reflected signals (echoes) to [a] microcontroller which times them to determine how far away the objects are, by using the speed of sound in air. The calculated range is then converted to a constant current signal and sent to the RCX." The Hitechnic sensor is different from the Polaroid sensor in that it has separate transmitter and receiver components while the Polaroid sensor combines both in a single piezoelectric transceiver; however, the basic operation is the same in both devices.

There are a number of complications involved in interpreting the time-of-flight information returned by an ultrasonic sensor. If the sensor face is parallel to the surface of the nearest object and that surface is flat, reflective and relatively large, e.g., a plaster wall, then the information returned by the sensor can be reasonably interpreted as the distance to the nearest object in front of the sensor. However if the object deviates significantly from this ideal object, the time-of-flight information can be misleading. Here is one of the more benign sorts of interpretation error caused by the fact that the signal (corresponding to a propagating wave of acoustic energy) spreads as it propagates further from the sensor with most of the energy of the leading edge confined to a 30 degree cone. If the surface is angled with respect to the face of the sensor (as it is below) then the time of flight information will record the distance to nearest point within the 30-degree cone. (End of quote)

Referring again to FIG. 4, the exemplary ultrasonic sensor based sensing system is clearly able to decipher motion as well as distance or height via the analysis of the acoustic transmissions and subsequent reflections through air.

Such a system provides a time based height signature that is able to detect scanned entities or potential hot water users that possess different physical attributes as depicted in FIGS. 5 and 6. Electronic control unit 404 is configured to detect various types of hot water users either as a unique individual user, a general category user, or any combination thereof; the detection of nonusers such as pets and the like, will be discarded by the system. Exemplary entities, depicted in FIG. 5 include a pet, child, adult, and an insect and their corresponding respective time based height signatures are depicted in FIG. 5*a*. Electronic control unit 404, electronic control unit interface 402, and physical attribute sensor(s) 406 cooperate such that detected entity or a potential user are properly classified via a physical attribute signature. Again, the methods and associated hardware for detecting and comparing sensor signals, along with activating signal controllable mechanisms such as blowers, burners, and valves is a well known, mature technology and implementation would not present an undue burden to those versed in the art.

Active De-Scaling of Coil Heat Exchanger

Scaling has been a long standing problem in the water heater industry. Typically lime and scale develop in fluid contacting surfaces of a hot water heater, causing water heater noises, reduction in hot water quantity, increased water heater operating costs, and a shorter water heater life. A heat exchanger coil of a water heater is particularly prone to scaling since the internal surfaces of the coil is routinely exposed to high temperatures. Scaling is often caused by the precipitation of minerals such as silicates, sulfates, and similar materials out of heated water to form water scale that coats fluid contacting surfaces. Scale formation is generally proportional to the temperature of a surface on which the scale is formed. Scale reduces hot water heating efficiency, interferes with proper functioning of a hot water heater due to false indications of water temperature at various temperature sensing points, increases maintenance requirements and costs. Various solutions have been proposed as regular maintenance measures to reduce or eliminate scaling. Conventional methods involve soaking and flushing scaled surfaces with scale dissolver to remove scale. Such process is time consuming, costly and causes down time. Therefore there exists a need for a process which eliminates down time and one that is carried out automatically without human intervention.

In the present invention, potential scale deposits due to overheating of water are eliminated by starting internal recirculation upon demand cessation. Internal recirculation causes a portion of unheated fluid in the internal recirculation line to be mixed with heated water thereby resulting in a lower average recirculated flow temperature.

Referring back to FIG. 2, in a flow based control scheme and upon detecting a cessation in demand, the burner 110 is turned off. At this point, portion 216 contains a volume of unheated (or cold) water from the water inlet 126. The solenoid valve 130 is then energized so that the pump 116 can continue to move water through the internal recirculation loop 134, causing the unheated volume of water in portion 216 to be mixed with warmer volumes of water in the heat exchanger 106, buffer tank 118 and other fluid conductor portions of the main flow loop and recirculation flow loop to ultimately bring the internal recirculation flow to a tempered flow of under 140 degrees Fahrenheit. Such a tempered flow is void of localized hot spots which promote scale formation. Potential scale deposits are further avoided by rejecting heat from the coil into its surroundings by running the blower 108 while internal recirculation is active.

We claim:

1. A hot water system comprising:

(a) a main flow line having an input point and a heated output point, wherein a pump, a buffer tank, and a heat exchanger are fluidly connected in line with and disposed within said main flow line and said pump is configured to move water in a direction of from said input point to said heated output point;

(b) an internal recirculation flow line connected in parallel configuration to said main flow line at said input point and said heated output point, said internal recirculation flow line comprises a first adjustable valve and a first check valve for directing flow from said heated output point to said input point; and (c) an external recirculation flow line connected in parallel configuration to said main flow line at said input point and said heated output point, said external recirculation flow line comprises a second check valve to prevent flow from said input point to said heated output point through said external recirculation flow line, wherein when said first adjustable valve and said second adjustable valve are disposed in an open position, the operation of said pump directs a first flowrate through said internal recirculation flow line and a second flowrate through said external recirculation flow line, therefore simultaneously forcing a flow heated by said heat exchanger through said internal recirculation flow line and external recirculation flow line.

2. The hot water system of claim 1, wherein a ratio of said first flowrate to said second flowrate ranges from about 52:48 (1.1) to about 95:5 (19).

3. The hot water system of claim 1, wherein said external recirculation flow line further comprises a thermostatic valve and a cold output point.

4. The hot water system of claim 1, wherein said first adjustable valve is a solenoid valve.

5. The hot water system of claim 1, wherein said first adjustable valve is a proportional valve.

6. The hot water system of claim 1, further comprising a user-activated heating control system.

7. The hot water system of claim 1, further comprising a first temperature sensor for providing a first temperature and a second temperature sensor for providing a second temperature, wherein said first temperature sensor is disposed upstream of said buffer bank and said second temperature sensor is disposed downstream of said buffer tank on said main flow line such that a trickle flow is indicated if said second temperature is higher than said first temperature by a predetermined differential.

8. The hot water system of claim 7, wherein said differential is about 4 degrees Fahrenheit.

9. The hot water system of claim 3, wherein said cold output point is connected to a cold water outlet.

10. The hot water system of claim 1, wherein said main flow line further comprises a holding tank to hold sufficient hot water for responding to peak loads.

11. A method for reducing delay of hot water delivery at a desired output temperature in a hot water system comprising a main flow line having an input point and a heated output point, wherein a pump, a buffer tank, a heat exchanger, a first temperature sensor and a second temperature sensor are fluidly connected in line with and disposed within said flow line and said pump is configured to move water in a direction of from said input point to said heated output point and burner operably connected to said heat exchanger, an internal recirculation flow line connected in parallel configuration to said main flow line at said input point and said heated output point, said internal recirculation flow line comprises a first adjustable valve and a first check valve for directing flow from said heated output point to said input point, an external recirculation flow line connected in parallel configuration to said main flow line at said input point and said heated output point, said external recirculation flow line comprises a second check valve to prevent flow from said input point to said heated output point through said external recirculation flow line and said first temperature sensor is disposed upstream of said buffer tank and said second temperature sensor is disposed downstream of said pump and downstream of said buffer tank, wherein said method comprises steps of:

(a) opening said first adjustable valve, turning on said pump to generate a flow in said internal recirculation flow line and said external recirculation flow line and turning on said burner; and (b) closing said first adjustable valve to stop said flow through said internal recirculation flow line and causing a flow through said external recirculation flow line only.

12. The method for reducing delay of hot water delivery of claim 11, further comprising a step of comparing the output of one of said first and said second temperature sensors to said desired output temperature, whereby if the output of one of said first and said second temperature sensors exceeds said desired output temperature by at least a first threshold, said flow through said external recirculation flow line is diverted to said internal recirculation flow line and if the output of said second temperature sensor exceeds said desired output temperature by at least a second threshold, said pump is turned off due to an indication of a dead heading condition in said external recirculation flow line.

13. The method for reducing delay of hot water delivery of claim 11, wherein said second threshold is about 5 degrees Fahrenheit.

14. A method for detecting trickle flow demand in a hot water system for delivering hot water at a desired output temperature, wherein said hot water system comprises a main flow line having an input point and a heated output point, wherein a pump, a buffer tank, a heat exchanger, a first temperature sensor and a second temperature sensor are fluidly connected in line with and disposed within said main flow line and said pump is configured to move water in a direction of from said input point to said heated output point and a burner operably connected to said heat exchanger, an internal recirculation flow line connected in parallel configuration to said main flow line at said input point and said heated output point, said internal recirculation flow line comprises a first adjustable valve and a first check valve for directing flow from said heated output point to said input point, an external recirculation flow line connected in parallel configuration to said main flow line at said input point and said heated output point, said external recirculation flow line comprises a second check valve to prevent flow from said input point to said heated output point through said external recirculation flow line and said first temperature sensor is disposed upstream of said buffer tank and said second temperature sensor is disposed downstream of said buffer tank, wherein said method comprises the step of:

comparing the output of said second temperature sensor to the output of said first temperature sensor, whereby if the output of said second temperature sensor is higher than the output of said first temperature sensor by a predetermined differential, a trickle flow is indicated.

15. The method for detecting trickle flow demand in a hot water system of claim 14, wherein said predetermined differential is about 4 degrees Fahrenheit.

16. A method for eliminating scale formation in a hot water system upon cessation of a hot water demand, said hot water system comprises a main flow line having an input point and a heated output point, wherein a pump, a buffer tank and a heat exchanger are fluidly connected in line with and disposed within said main flow line and said pump is configured to move water in a direction of from said input point to said heated output point and a burner is operably connected to said heat exchanger and an internal recirculation flow line is connected in parallel configuration to said main flow line at said input point and said heated output point, said internal recirculation flow line comprises an adjustable valve and a check valve for directing flow from said heated output point to said input point, wherein said method comprises steps of:

(a) creating a flow in said internal recirculation flow line by opening said adjustable valve and turning on said pump to dissipate heat from said flow; and (b) turning off said burner, thereby ceasing heat addition to said flow.

17. The method for eliminating scale formation in a hot water system of claim 16, wherein said hot water system further comprises a blower operably coupled to said burner, said method further comprises a step of:

turning on said blower to dissipate heat from said flow in said internal recirculation flow line.

* * * * *